United States Patent [19]

Strydom

[11] Patent Number: 4,702,263

[45] Date of Patent: Oct. 27, 1987

[54] TOBACCO SMOKE FILTERS

[75] Inventor: Mauritz L. Strydom, Stellenbosch, South Africa

[73] Assignee: Tobacco Research and Development Institute Limited, Switzerland

[21] Appl. No.: 865,349

[22] Filed: May 20, 1986

[30] Foreign Application Priority Data

May 20, 1985 [ZA] South Africa ..... 85/3788

[51] Int. Cl.[4] ..... A24D 3/04

[52] U.S. Cl. ..... 131/336; 131/338; 131/198.1; 131/215.2

[58] Field of Search ..... 131/336, 198.1, 198.2, 131/215.1, 215.3, 338

[56] References Cited

U.S. PATENT DOCUMENTS 4,559,955 12/1985 Brockway et al. ..... 131/198.2

4,615,344 10/1986 Ringrose ..... 131/215.3

4,620,553 11/1986 Bale et al. ..... 131/336

*Primary Examiner*—V. Millin

*Assistant Examiner*—H. Macey

*Attorney, Agent, or Firm*—Kinzer, Plyer, Dorn, McEachran & Jambor

[57] ABSTRACT

An insert is interposed between the tobacco containing portion and the filter tip of a cigarette. The insert is formed with a passage connecting the two sections. The passage is surrounded by an annulus with two diametrally opposed orifices between the passage and the orifices. Rings surround the insert over the area of each orifice. The rings fit loosely around the insert. The annulus is covered with perforated paper. In use a smoker who wants a mild taste puffs weakly while if he wants a strong taste he puffs heftily so that the rings close the orifices.

3 Claims, 2 Drawing Figures

TOBACCO SMOKE FILTERS

BACKGROUND TO THE INVENTION

This invention relates to cigarettes.

It has already been proposed to make so-called "mild" cigarettes which have perforated paper wrappings allowing air to enter the main stream of gas flowing from the glowing ember to the smoker's mouth. In some cases the perforations are in the filter zone of the cigarette.

Mild cigarettes are unacceptable to some smokers and often the same smoker may at different times demand a mild cigarette and then a strong cigarette.

SUMMARY OF THE INVENTION

According to the invention a cigarette comprises a paper encased body filled with cut tobacco, a filter tip at one end of the body, and interposed between the filter tip and the body an insert providing a main flow path between the body and the filter tip, a space covered by perforated paper, an orifice between the space and the main flow path, and a valve member arranged to obturate the orifice when the flow through the orifice exceeds a predetermined level.

Thus in order to get a mild taste the smoker puffs weakly while in order to get a strong taste he puffs heftily so that the predetermined level is exceeded.

DESCRIPTION OF AN EMBODIMENT

Figure 1:
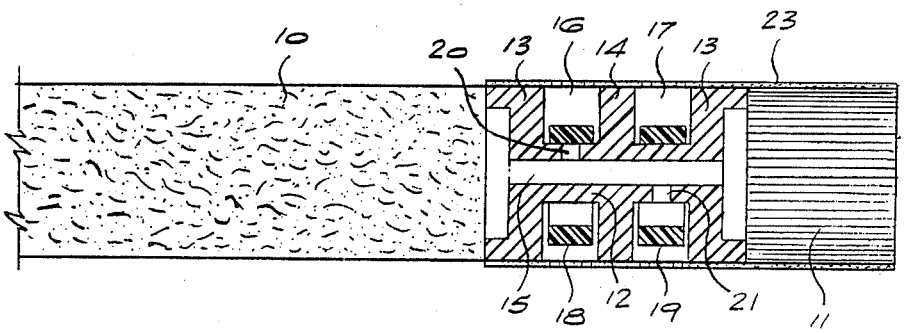
FIG. 1 is a section through the rear end of a cigarette on an enlarged scale.

In FIG. 1 a cigarette is shown with a smoking end 10 filled with cut tobacco, a filter 11 of any conventional material and an insert 12 between the filter 11 and the tobacco 10.

The insert 12 is formed with recessed end flanges 13, a central flange 14 and a bore 15 along which smoke can pass from the tobacco 10 to the filter 11.

The flanges 13 and 14 define two annular spaces 16 and 17 occupied by rings 18 and 19. Orifices 20 and 21 lead on diametrically opposed sides from the annular spaces to the bore 15. The filter wrapping 23 is perforated in the region of the spaces 16 and 17.

When the cigarette is held normally either or both of the orifice 20 and 21 will be open so that air can flow through the wrapping 23 into an annular space and through an orifice 20 or 21 to the bore 15. When a cigarette so held is smoked and the smoker does not draw too violently, a mild smoke is experienced. On the other hand when a strong draw is exerted, the rings 18 and 19 close the orifices 20 and 21 so that a strong smoke is experienced.

Figure 2:
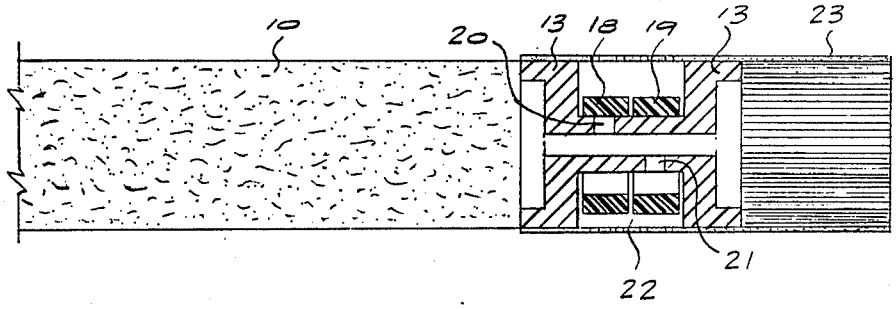
FIG. 2 is a similar section through the rear end of another cigarette.

In FIG. 2 the flange 14 has been left out and there is a single annulus housing the two rings 18 and 19. The orifices 20 and 21 are still the same. The operation of the device is much the same as that of FIG. 1. In both cases the sizes of the orifices 20 and 21 and the masses of the rings 18 and 19 are chosen to give the desired degree of ventilation during the mild phase of smoking. By changing the specific gravity of the material of the rings flows of between 25 ml/s and 55 ml/s through the orifices 20 and 21 are possible before the rings close the orifices.

I claim:

1. A cigarette comprising:

a paper encased body filled with cut tobacco, a filter tip at one end of the body, an insert interposed between the body and the filter tip, an axial bore through the insert, the insert preventing flow of gas between the body and the filter tip except along the bore, an annular waist in the insert around the bore, perforated paper covering the waist to form an enclosed annular space, an orifice between the annular space and the bore, and a ring loosely surrounding the waist so that when the flow through the orifice exceeds a predetermined level, the ring obturates the orifice.

2. The cigarette claimed in claim 1 in which there are two axially spaced opposed orifices from the annular space to the bore and each orifice is controlled by a separate ring.

3. The cigarette claimed in claim 2 in which the space is divided in two by a dividing flange.

* * * * *